US005716302A

United States Patent [19]

Andersson

[11] Patent Number: 5,716,302

[45] Date of Patent: Feb. 10, 1998

[54] DUMMY ARRANGED TO REGISTER HITS AGAINST THE DUMMY

[75] Inventor: Stefan Andersson, Farsta, Sweden

[73] Assignee: Lars Andersson, Trangsund, Sweden

[21] Appl. No.: 669,308

[22] PCT Filed: Jan. 10, 1995

[86] PCT No.: PCT/SE95/00013

§ 371 Date: Jul. 5, 1996

§ 102(e) Date: Jul. 5, 1996

[87] PCT Pub. No.: WO95/18655

PCT Pub. Date: Jul. 13, 1995

[30] Foreign Application Priority Data

Jan. 11, 1994 [SE] Sweden ..... 9400047

[51] Int. Cl.[6] ..... A63B 64/34

[52] U.S. Cl. ..... 482/84; 482/83

[58] Field of Search ..... 482/83–90, 8; 473/441–445

[56] References Cited

U.S. PATENT DOCUMENTS

| | | | |
|---|---|---|---|
| 4,088,315 | 5/1978 | Schemmel . | |
| 4,440,400 | 4/1984 | Neuberger . | |
| 4,565,366 | 1/1986 | Struss . | |
| 4,941,660 | 7/1990 | Winn et al. | 482/84 |
| 4,974,833 | 12/1990 | Hartman et al. . | |
| 5,288,905 | 2/1994 | Micco | 482/84 |

FOREIGN PATENT DOCUMENTS

| | | | |
|---|---|---|---|
| 380371 | 9/1923 | Germany . | |
| 2232039 | 1/1973 | Germany . | |
| 2822205 | 11/1979 | Germany . | |
| 1718994 | 3/1992 | U.S.S.R. | 482/84 |
| 2249033 | 4/1992 | United Kingdom | 482/84 |

*Primary Examiner*—Jerome Donnelly
*Attorney, Agent, or Firm*—Alfred J. Mangels

[57] ABSTRACT

A dummy which is constructed to register blows inflicted thereon, wherein the dummy includes one or more sensors at the location or those locations on the dummy where a blow or blows delivered thereto shall be registered, and wherein the sensor or sensors is/are adapted to deliver an electric signal to a computer. The sensor (3, 13, 14) includes a pressure sensor (5) which is adapted to deliver an electric signal which corresponds to the pressure generated in the pressure sensor in response to a blow landing on said sensor; and in that the surface of the sensor (3, 13, 14) parallel with the dummy surface on which the sensor is attached is divided into two or more sections (4), where each section (4) is adapted to deliver an electric signal when the blow lands on the section concerned.

10 Claims, 1 Drawing Sheet

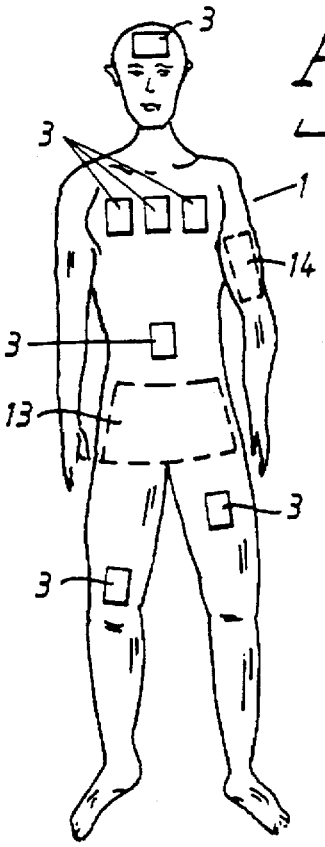
Fig. 1
Fig. 2
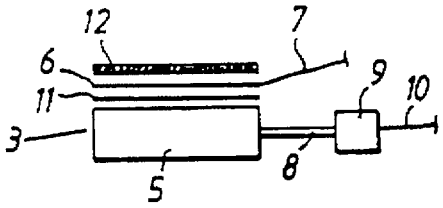
Fig. 3
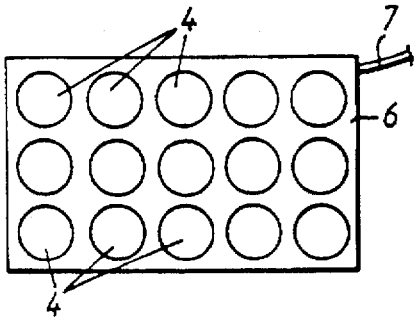
Fig. 5
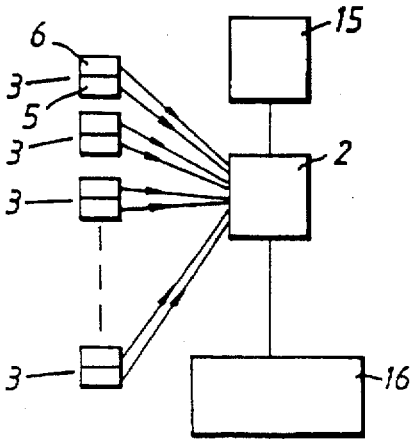
Fig. 4
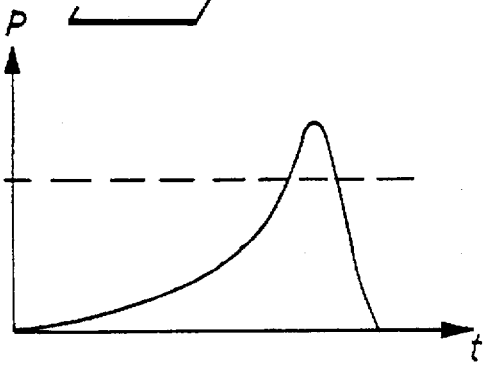

DUMMY ARRANGED TO REGISTER HITS AGAINST THE DUMMY

BACKGROUND OF THE INVENTION

1. Field of the Invention

The present invention relates to a dummy which resembles a normal sized human being and which is constructed to register blows that are inflicted on the dummy.

2. Description of the Related Art

Tendencies towards violence have increased in society in recent years. This tendency affects all types of persons, both young and old. It has also become more common for those who exercise violence against others to be relatively young.

The violence shown in films, television and above all in video films has become more and more pronounced, as have also the snapshot portrayals of war throughout the world. This has led to the natural, inherent "stop mechanism" against exercising violence on other persons being considerably blunted in many people.

For instance, a person who kicks another person in the head or hits a person with an iron pipe wrapped in cloth in the belief that the person concerned will only lose consciousness without being seriously injured must be unaware of the relationship between the blow and the injury that can be caused as a result thereof.

Consequently, there is a need to be able to demonstrate the types of injury that a given blow can cause. Such demonstrations could be given in schools, within youth organizations, in conjunction with the training of policemen, defense personnel and guards, and also in the education of nursing and health care personnel. One object in this regard may be to exhibit violence for an anti-violence purpose. Another object, for instance, may be to train police in the handling of a baton without causing unnecessary injuries.

The present invention satisfies this need.

SUMMARY OF THE INVENTION

The present invention thus relates to a dummy which is constructed to register blows inflicted on the dummy and which is provided with one or more sensors at that location or those locations on the dummy where blows inflicted thereon shall be registered, the sensors being intended to deliver an electric signal to a computer, wherein the dummy is characterized in that the sensor includes a pressure sensor which is intended to deliver an electric signal which corresponds to the pressure generated in the sensor as a result of a blow inflicted thereon; in that the surface of the sensor that extends parallel with the dummy surface on which the sensor is attached is divided into two or more sections and in that each section is adapted to deliver an electric signal when a blow strikes the section concerned.

BRIEF DESCRIPTION OF THE DRAWINGS

The present invention will now be described in more detail partly with reference to an exemplifying embodiment thereof shown on the accompanying drawing, in which FIG. 1 is a front view of a dummy;

FIG. 2 is a cross-sectional view of a sensor with the various components separated for the sake of clarity;

FIG. 3 illustrates a membrane switch from above;

FIG. 4 is a pressure-time curve; and

FIG. 5 is a block schematic.

DESCRIPTION OF THE PREFERRED EMBODIMENTS

FIG. 1 illustrates schematically a dummy constructed in accordance with the invention. The dummy has the same size as a human being. The dummy may be of any kind whatsoever, and may, for instance, be of the same kind as a tailor's dummy. It is important, however, that the dummy is constructed to withstand heavy blows that are delivered with such power as to cause a person who received such blows to be inflicted very serious injury or suffer death.

The dummy 1 is constructed to register blows inflicted on the dummy. To this end, the dummy is provided with one or more impact sensors 3 on that location or those locations on the dummy at which blows inflicted thereon shall be registered, these impact sensors being adapted to deliver an electric signal to a signal processor 2 (see FIG. 5). The body locations in question are primarily the head, the chest, the stomach, the upper arms and forearms, and the thighs and lower parts of the legs. Naturally, impact sensors 3 can also be placed at other locations in accordance with the type of violence to be registered.

According to the invention, impact sensor 3 includes a pressure sensor which is adapted to deliver an electric signal corresponding to the pressure generated in the pressure sensor as it is struck by a blow. The outer surface of the impact sensor 3, which extends parallel with the surface of the dummy at the location in which the impact sensor 3 is attached to the dummy, is divided into two or more sections 4, of which each section 4 is adapted to deliver an electric signal when a blow is delivered to the section concerned.

FIG. 2 is a cross-sectional view of an impact sensor 3, in which the impact sensor components have been separated for the sake of clarity. The reference numeral 5 identifies a flexible, bladder-like container which contains a fluid. For instance, the container 5 may be a parallelepipedic rubber container which contains a fluid such as air, water or oil. However, a compressible medium, such as air, is preferred because it will dampen the force of a blow directed onto the sensor. A pressure medium line 8 extends from the container 5 to a suitable known pressure transducer 9 which is adapted to deliver an analog electric signal corresponding to the fluid pressure in the container 5. The reference numeral 10 identifies the signal conductor extending from the pressure transducer. The pressure transducer 9 may, for instance, be a pressure transducer of the kind marketed by Motorola under the designation MPX 10.

The container 5 is intended to be placed on and secured to the dummy surface in some suitable way, for instance glued thereto. The container may also be very thin, for instance have a thickness in the order of only about one centimeter.

A membrane switch 6 is located outside the container 5, as seen from the surface of the dummy. This switch includes a number of fields 4, (see FIG. 3) which form said sections and each of which forms a circuit switch, see FIG. 3. The reference numeral 7 in FIGS. 2 and 3 identifies a multi-cable which extends to each of said fields.

The membrane switch 6 may be of any suitable kind. Switches of this kind are available commercially in many different designs. An analog on/off membrane switch of the type Brady F12AC4 can be used in the present context, for instance.

According to one preferred embodiment of the invention, there is located between the container 5 and the membrane switch 6 an intermediate plate 11 which functions to distribute the force imparted by a blow across the surface of the container. This enables the container to be made thinner than if the intermediate sheet was not present. The intermediate sheet shall be relatively durable so as to withstand the forces to which it is subjected. For instance, the intermediate plate may be comprised of a strong plastic material, such as ABS plastic. The intermediate plate has the same surface area as the container 5 and the membrane switch 6.

The container 5, the intermediate plate 11 and the membrane switch 6 are preferably glued together.

According to another preferred embodiment of the invention, a protective damping or attenuating material 12, preferably foamed rubber, is placed on the membrane switch 6. This protective layer is intended to protect the membrane switch and also the impact sensor 3 as such.

FIG. 3 is a schematic illustration of a membrane switch 6 view from above. This switch 6 has three times five fields 4, each of which forms a circuit switch. Naturally, the membrane switch 6 may be given more or fewer fields 4, and the fields may have a shape other than circular.

The size of the membrane switches 6 can be varied in accordance with their positions on the dummy and also in accordance with the type of blow that a respective switch is intended to register.

However, it is preferred that each impact sensor 3 will have a minimum size of about 10×10 centimeters, so that a blow will land entirely only on the sensor and not partly on that part of the dummy which surrounds the sensor. The sensor will also preferably include at least 3×3 fields, so as to be able to register whether the entire sensor surface was struck or only parts of said surface, and so that the size of the impact area can be calculated.

The reference numeral 3 in FIG. 1 identifies impact sensors of a given type that have been placed in different positions on the dummy towards which blows shall be directed.

However, a preferred alternative is one in which one or more sensors 13, 14 have a shape which is adapted to the shape of a part of the body or to a section thereof. Such sensors are illustrated in broken lines in FIG. 1, where the sensor 13 is adapted particularly to the lower part of the stomach and the sensor 14 is adapted to the upper arm.

According to one preferred embodiment of the invention, the whole of the dummy surface, or essentially the whole of said surface, is covered with sensors. Naturally, the number of sensors used and the surface area of the dummy covered by said sensors will depend on the purpose for which the dummy is intended.

In some cases, such as when registering injuries to the head, it suffices to provide only the head with sensors.

When sensors are provided over the whole of the dummy, it has been estimated that about 1,600 membrane switches need to be placed on the dummy in order to be able to determine with great certainty that the blow inflicted would have inflicted an injury and also the extent of this injury. In this regard, it is important to mention that the need of the resolution given by the membrane switches with regard to the impact surface area will vary in different positions on the body. For instance, a higher resolution is required on the head than on the forearm for instance. A suitable sensor for a forehead region may, for instance, include a row of juxtaposed membrane switches where each membrane switch has a diameter of 1 millimeter. The person skilled in this art, however, will have no difficulty in testing sensors for appropriate resolution.

Thus, in accordance with the invention, those fields 4 that are struck by the blow will each deliver an electric signal to the computer and are therewith registered therein. FIG. 5 illustrates a number of sensors 3 of which each has an upper part 6, which is the membrane switch, and a lower part 5, which is the fluid container. Each membrane switch sends via conductors a signal to the computer 2 which denotes those fields or circuit switches that have been struck by the blow. The pressure in each container 5 is also registered, by virtue of the pressure transducer 9 delivering to the computer 2 a signal which corresponds to the pressure in the container 5.

Thus, when a blow lands on a sensor, the sensor delivers to the computer through the medium of the membrane switches information concerning the size of the surface that is struck and also information concerning the resulting pressure in the several container 5. This pressure is a measurement of the force at which the impact sensor 3, i.e. the dummy, was struck. Because the force of the blow and the size of the impact surface are known, it is possible to calculate the effect of the blow in the form of probable injury to a human being.

For instance, the calculation can be based on the actual injuries sustained by people as a result of bodily assault or accidents, and therewith map the force of a blow inflicted on a person and, when applicable, the type of weapon used, whereafter the blow is repeated on the dummy and the pressure and impact surface area are registered. In this way, different limit values relating to pressure and impact area can be imput in the computer 2 and used in the computer for comparison with those values delivered by a sensor to the computer in response to a blow that lands on the dummy. The broken line in FIG. 4 illustrates a pressure limit value. In one embodiment, only the maximum pressure resulting from a blow is registered.

The limit values relating to the probable injury of a person as a result of a blow will vary in accordance with the position of an impact sensor on the body. Furthermore, it is conceivable to store in the computer several limit values for a given impact sensor, so as to be able to grade the extent of probable injuries. For instance, the limit values concerned with a sensor that is placed on the head may indicate that a person would suffer severe concussion or a fractured skull.

The limit values may also be adjusted in accordance with sex and age of the person who is assumed to have received a blow.

The aforesaid limit values are conveniently stored in a memory 15 belonging to the processor 2. The processor 2 is connected to an appropriate display device 16 which displays the magnitude of the injury that would be sustained by a given blow. The processor 2, the memory 15 and the display device 16 may for instance be comprised of a personal computer, where the display device is the monitor.

According to one very essential embodiment of the invention, the processor 2 is intended to register the output signals from each of the pressure transducers 9 as a pressure-time sequence when a blow lands on an impact sensor 3, as exemplified in FIG. 4 where P stands for pressure and t stands for time. In the case of this embodiment, the processor receives information concerning the duration of the blow and information concerning the duration of the pressure above a certain predetermined pressure level. This enables the probable injury that would be sustained to be calculated more precisely than would be the case when this time information was lacking.

In the case of this embodiment, the computer 2 is preferably adapted to compare the duration and maximum value of the pressure-time sequence with predetermined durations and maximum values and also with the size of the surface area that has been struck by a blow, thereby being able to calculate whether a person who had been struck by the blow in question would have suffered an injury.

As before mentioned, the number of measuring points may be 1,600. It may be highly beneficial to include a processor 2 and associated memory 15 in the actual dummy, particularly when the number of measuring points is large, in which case each membrane switch 6 is connected to the processor 2. In this case, the processor 2 will either form a part of the aforesaid computer or the whole of said computer. According to one preferred embodiment of the invention, the primary purpose of the processor, however, is to collect the measurement values and to deliver a signal which corresponds to the size and the form of the impact surface and the resultant pressure or force. The measurement results themselves can be evaluated thereafter in a personal computer to which the processor is connected.

It will be evident from the foregoing that the invention enables those injuries that could be inflicted with different types of blows, either with or without a weapon, to be explained and demonstrated in an illustrative manner, thereby enabling different people to be given a feeling of the relationship between blows and the injuries that they can inflict.

A number of exemplifying embodiments have been described above. However, the configuration of the sensors can be varied and adapted in accordance with their respective positions.

The present invention is therefore not restricted to the aforedescribed embodiments, since modifications and changes can be made within the scope of the following Claims.

What is claimed:

1. A dummy which is constructed to register blows inflicted thereon, wherein the dummy includes one or more impact sensors positioned at locations on the dummy where a blow or blows delivered thereto are to be registered, and wherein each impact sensor is adapted to deliver an electrical signal to a computer, wherein the impact sensor includes a pressure transducer which is adapted to deliver a first electrical signal which corresponds to the pressure imposed on the impact sensor as a result of a blow landing on said sensor; and wherein an outer surface of the impact sensor is parallel with an underlying surface of the dummy onto which the impact sensor is attached and includes a membrane switch which is divided into a plurality of sections, where each section is adapted to deliver a second electric signal when a blow lands on the section concerned to provide a signal representative of the area over which the blow extends, and wherein the computer is adapted to receive said first electric signal from the pressure transducer and to provide a pressure-time sequence as an output.

2. A dummy according to claim 1, wherein the impact sensor includes from its surface facing towards the dummy and outwardly thereof a flexible, bladder-like, fluid-containing container and said membrane switch is located outside the container and includes a plurality of sections, each of said sections defining a circuit switch to register the area over which a blow is inflicted.

3. A dummy according to claim 2, wherein there is positioned between the container and the membrane switch an intermediate plate to distribute across a surface of the container the force delivered by a blow.

4. A dummy according to claim 2, including a protective damping material provided on an outer side of the membrane switch.

5. A dummy according to claim 1, wherein each impact sensor measures at least about 10×10 centimeters and contains at least 3×3 sections.

6. A dummy according to claim 1, wherein the shape of at least one impact sensor conforms to a body section shape.

7. A dummy according to claim 6, wherein substantially the whole of the dummy surface is covered with impact sensors.

8. A dummy according to claim 1, including a memory for storing predetermined durations and maximum pressure-time sequence values and wherein the computer is adapted to compare the duration and maximum value of a pressure-time sequence with the predetermined durations and maximum pressure-time sequence values and also to determine the size of the surface struck by a blow, to determine whether an injury could be considered to have been inflicted if the blow concerned had been directed towards a human being.

9. A dummy according to claim 1, wherein the computer includes a processor and associated memory included within the dummy, and wherein each membrane switch is connected to the processor; and wherein the processor is adapted to collect blow impact measurement values and to deliver a signal which corresponds to the form and size of the surface impacted and the pressure applied to the surface that is impacted.

10. A dummy according to claim 5, wherein the protective damping material is foam rubber.

* * * * *